US006470502B2

(12) United States Patent
Lu

(10) Patent No.: US 6,470,502 B2
(45) Date of Patent: Oct. 29, 2002

(54) AUTOMATICALLY RAISED TOILET SEAT APPARATUS

(76) Inventor: Shou Chi Lu, 1F, No. 462, Chung Hsiao E. Rd., Sec. 5, Taipei (TW)

( * ) Notice: Subject to any disclaimer, the term of this patent is extended or adjusted under 35 U.S.C. 154(b) by 0 days.

(21) Appl. No.: 09/987,509

(22) Filed: Nov. 15, 2001

(65) Prior Publication Data

US 2002/0059676 A1 May 23, 2002

(30) Foreign Application Priority Data

Nov. 21, 2000 (TW) ..... 89220183 U

(51) Int. Cl.[7] ..... A47K 13/10

(52) U.S. Cl. ..... 4/246.1; 4/246.2; 4/237; 4/241

(58) Field of Search ..... 4/246.1, 246.2, 4/241, 237, 248

(56) References Cited

U.S. PATENT DOCUMENTS 4,910,810 A * 3/1990 Solomon ..... 4/241
5,138,724 A * 8/1992 Chien et al. ..... 4/246.2
5,435,017 A * 7/1995 Pan ..... 4/246.2
5,940,896 A * 8/1999 Berring ..... 4/246.1

FOREIGN PATENT DOCUMENTS

IT 310453 * 8/1933 ..... 4/241
NL 9002115 * 4/1992 ..... 4/241

* cited by examiner

*Primary Examiner*—Charles R. Eloshway
(74) *Attorney, Agent, or Firm*—Rosenberg, Klein & Lee

(57) ABSTRACT

An automatically raised toilet seat apparatus is provided. The toilet seat apparatus includes a toilet seat portion and a pair of box portions. The body of each box portion forms a closed space which contains a liquid and defines a plurality of tank compartments. Baffles separate at least some of the tank compartments. The liquid's adaptive distribution between tank compartments facilitates the toilet seat portion's gradual displacement between lowered raised positions, biasing the toilet seat portion to one of those positions. In certain cases, a pair of shallow holes and a pair of deep holes are formed into the toilet seat portion, for adjustably receiving the box portions, depending on the size of the given toilet's water tank.

3 Claims, 6 Drawing Sheets

AUTOMATICALLY RAISED TOILET SEAT APPARATUS

FIELD OF THE INVENTION

The present invention relates to an automatically raised toilet seat apparatus and, more particularly, to an automatically raised toilet seat apparatus that is adaptable to toilets having different configurations.

BACKGROUND OF THE INVENTION

Referring to FIG. 1, there is shown a perspective view of the prior art. The two side ends of a toilet seat 1 extend backward to form a pair of gravity shifting box portions 2' which shift the gravity center rearward to a point behind a pivot center 12 of the toilet seat gradually. It operates using guided water flow in the box 2', such that during periods when the toilet seat is not in use, the seat is raised up automatically. Therefore, a balance weight is installed to keep toilet seat 1 balanced. The side of each box 2' has a filling hole 23 through which a liquid is injected into each box 2'. At the side of each box 2' is installed a throttle screw 230 to close the filling hole 23.

One such prior art toilet seat is shown in U.S. Pat. No. 5,138,724, issued to Chien et al. The present invention provides improvements, as described herein, upon toilet seats of this general type.

Such prior art toilet seats cannot adapt to different toilet configurations because the toilet seat is of unitary, integrally-formed structure. The toilet seat cannot be installed on a toilet if it is sufficiently deviant in configuration. In general, using the convenience of such automatically raised toilet seat necessary requires a change of the original toilet seat, and would thereby waste resources.

SUMMARY OF THE INVENTION

Accordingly, a primary object of the present invention is to provide an automatically raised toilet seat having a toilet seat and at least one box. The automatically raised toilet seat is adaptable to different toilet configurations, and would not be difficult to install even when a big water tank is employed.

Another object of the present invention is to provide an automatically raised toilet seat that could be formed by refitting a toilet with an automatically raised toilet seat formed in accordance with one embodiment of the present invention, or by keeping the original toilet seat, and adaptively coupling thereto at least one box in accordance with an alternate embodiment of the present invention.

DETAILED DESCRIPTION OF THE PREFERRED EMBODIMENTS

Figure 1:
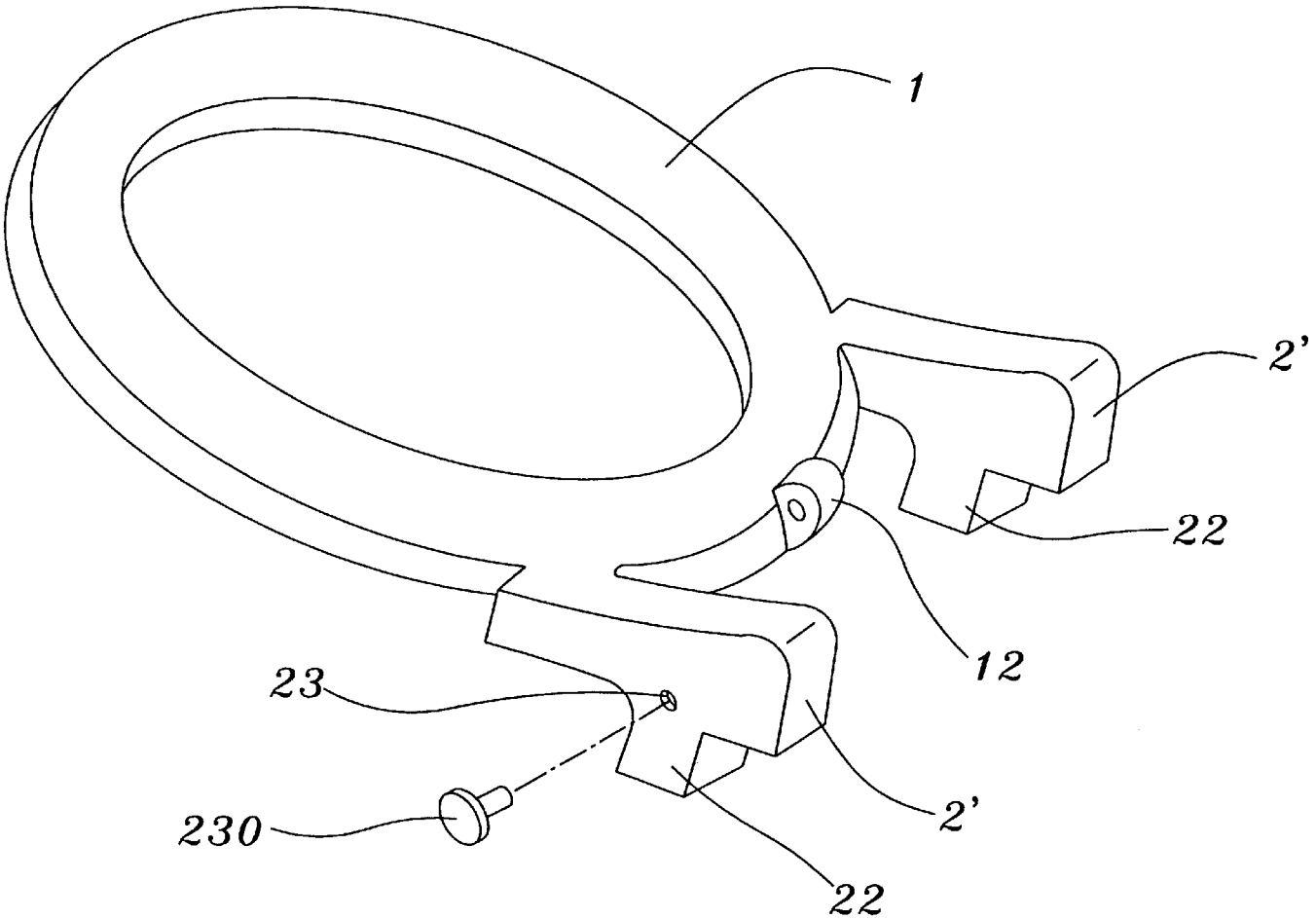
Fig. 1 (Prior Art)
FIG. 1 is a perspective view of the prior art.
Figure 2A:
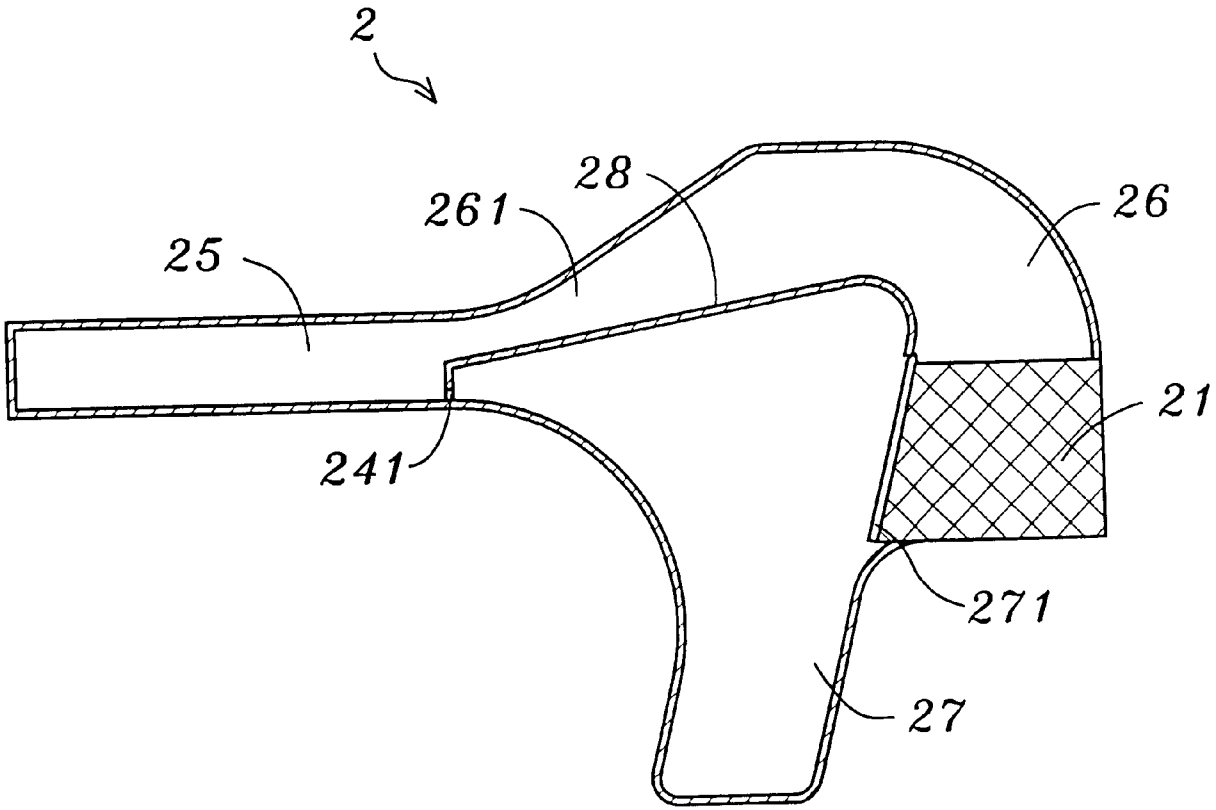
FIG. 2A is a side-sectional view of one embodiment of a portion of the present invention.
Figure 2B:
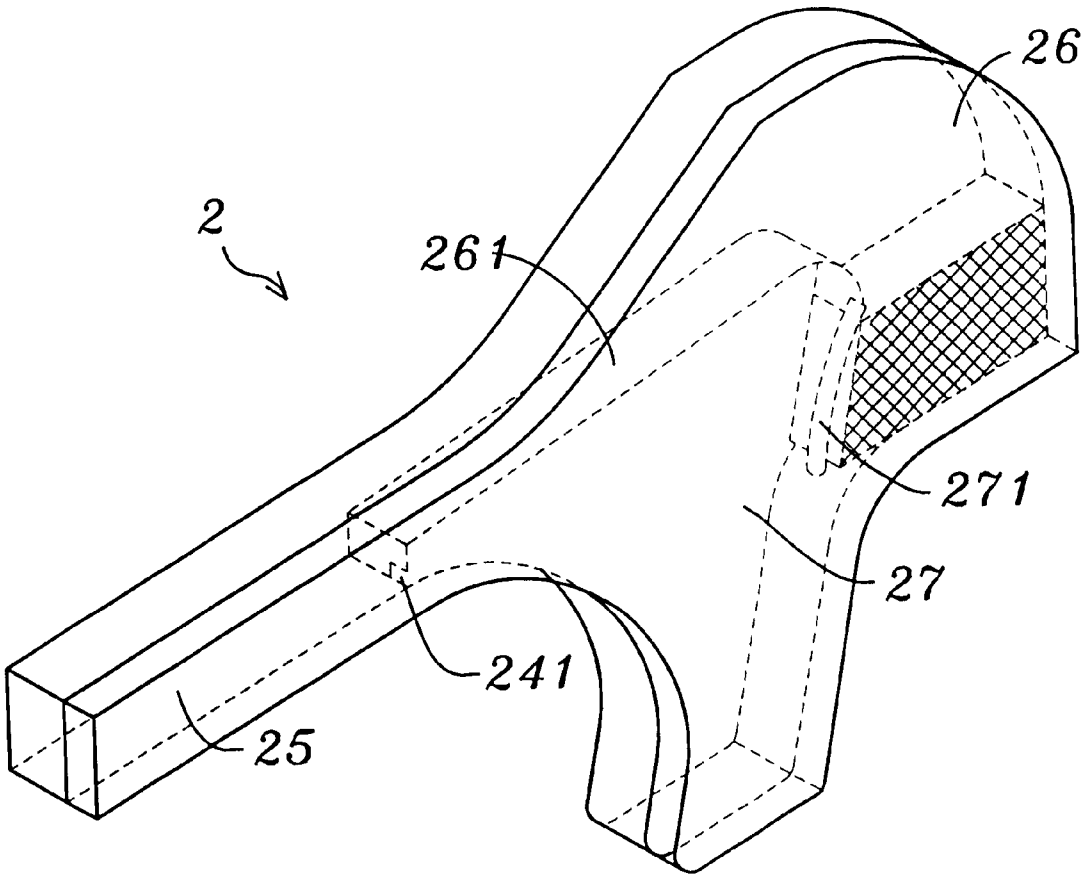
FIG. 2B is a perspective view of the portion shown in FIG. 2A.

Referring to FIG. 2A and FIG. 2B, there are shown side-sectional and perspective views of a box 2 of the present invention. Generally, box 2 is configured as a closed hollow body. The closed hollow body includes three sections, a front tank 25, a backward tank 26, and an underneath tank 27, the tanks being separated in part by baffles 28. The front tank 25 communicates with the backward tank 26 through a slope-neck 261, but is partitioned from the underneath tank 27. The backward tank 26 is connected to underneath tank 27 by a vessel 271 instead of a hole. The underneath tank 27 communicates with the front tank 25 through a hole 241, wherein the passage dimension defined by the slope-neck 261 is greater than that defined by the vessel 271. A balance weight 21 is installed at the back of the box 2, and is equal to the toilet seat in weight. In the embodiment shown, migration of the liquid between the tanks alters the given toilet seat's bias in the manner generally shown, for example, in U.S. Pat. No. 5,138,724 issued to Chien et al., such that unless restrained, the toilet seat subsequently returns to its raised position upon being placed in its lowered position.

Figure 3:
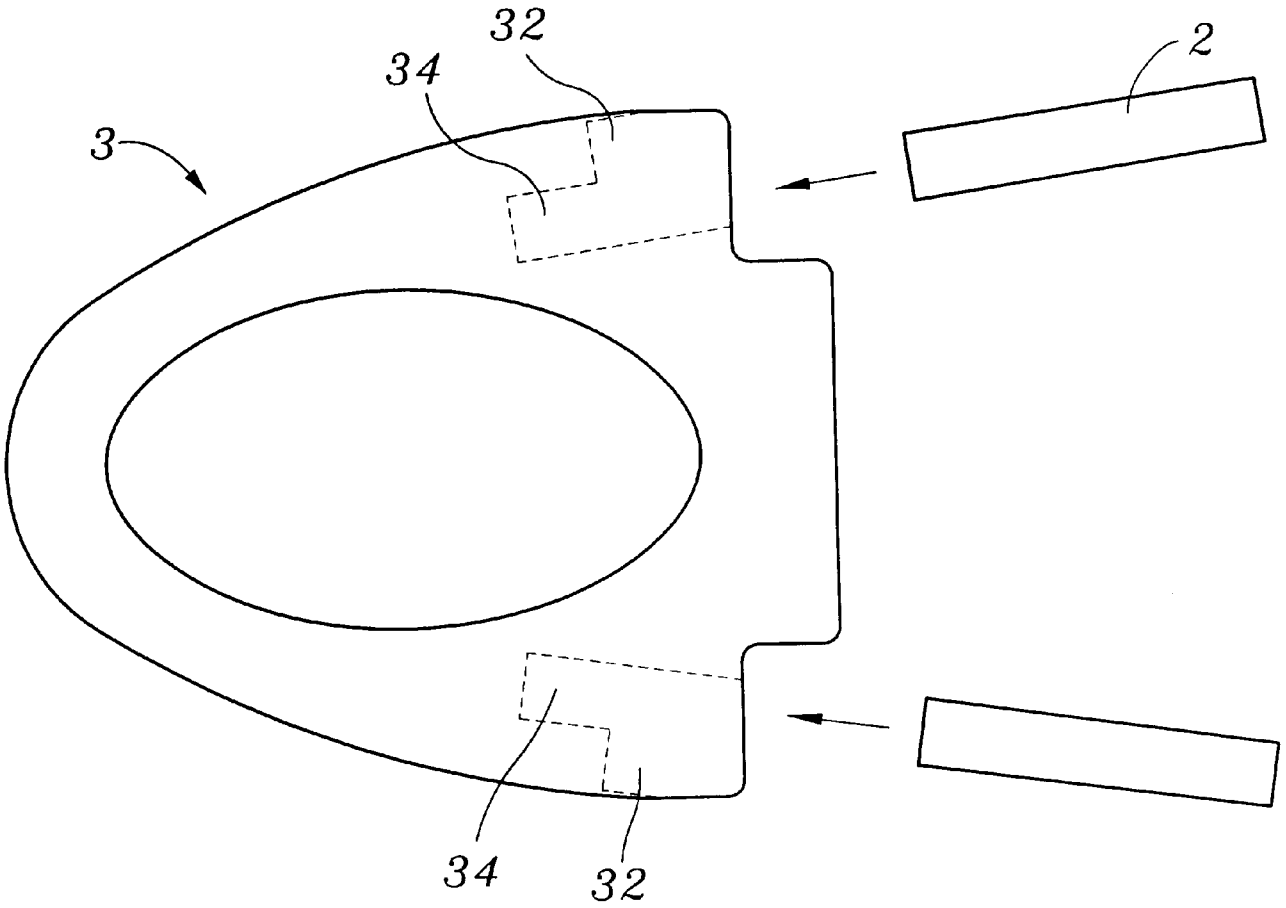
FIG. 3 is a top view of one embodiment of the present invention.

Referring to FIG. 3, there is a top view of a shallow hole 32 and a deep hole 34 formed into the toilet seat 3. The shallow hole 32 is disposed to extend within an outer side of toilet seat 3, while the deep hole 34 is disposed internally adjacent a shallow hole 32. The boxes 2 can be installed in either hole 32, 34 (inside or external), according to the width of the given water tank.

Figure 4:
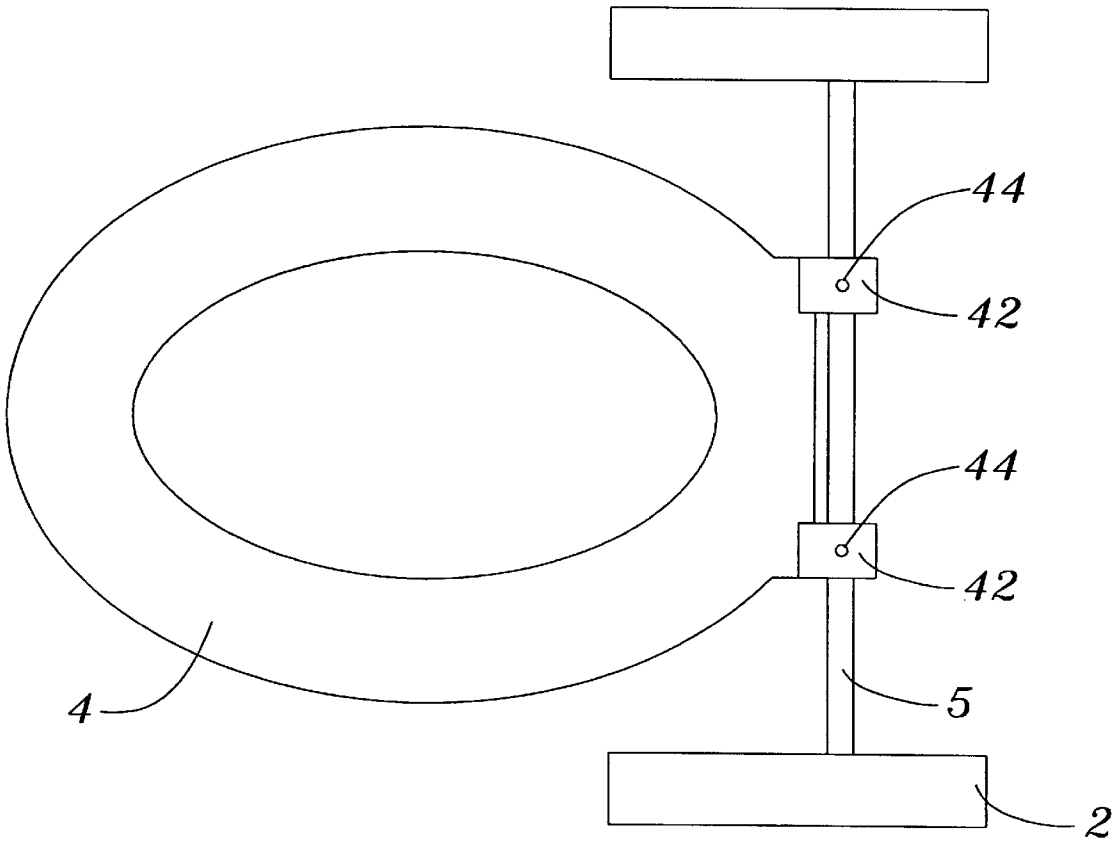
FIG. 4 is a top view of an alternate embodiment of the present invention.

Referring to FIG. 4, there is shown a top view of a crankshaft 5 disposed to extend transversely back of a traditional toilet seat 4. The crankshaft length may be selectively set depending on the water tank width such that the traditional toilet seat 4 may pivotally displace freely with the crankshaft 5. The boxes 2 can be fastened at opposed ends of the crankshaft 5 so that the traditional toilet seat 4 is provided with an automatic rising capability.

Figure 5:
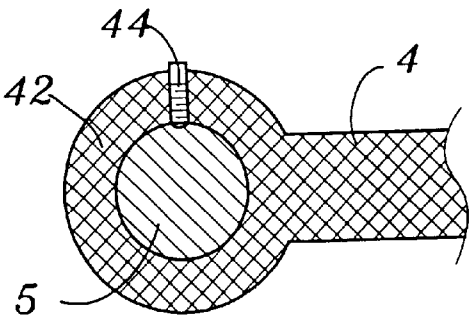
FIG. 5 is a sectional view of a portion of the alternate embodiment shown in FIG. 4; and, FIG. 6 is a perspective view of yet another alternate embodiment of the present invention assembled to a water tank equipped with a flush control macro switch.

Referring to FIG. 5, there is shown a sectional view of the crankshaft 5 coupled to a housing 42 extending from the toilet seat 4 backward. The coupling is fastened with a screw 44.

Figure 6:
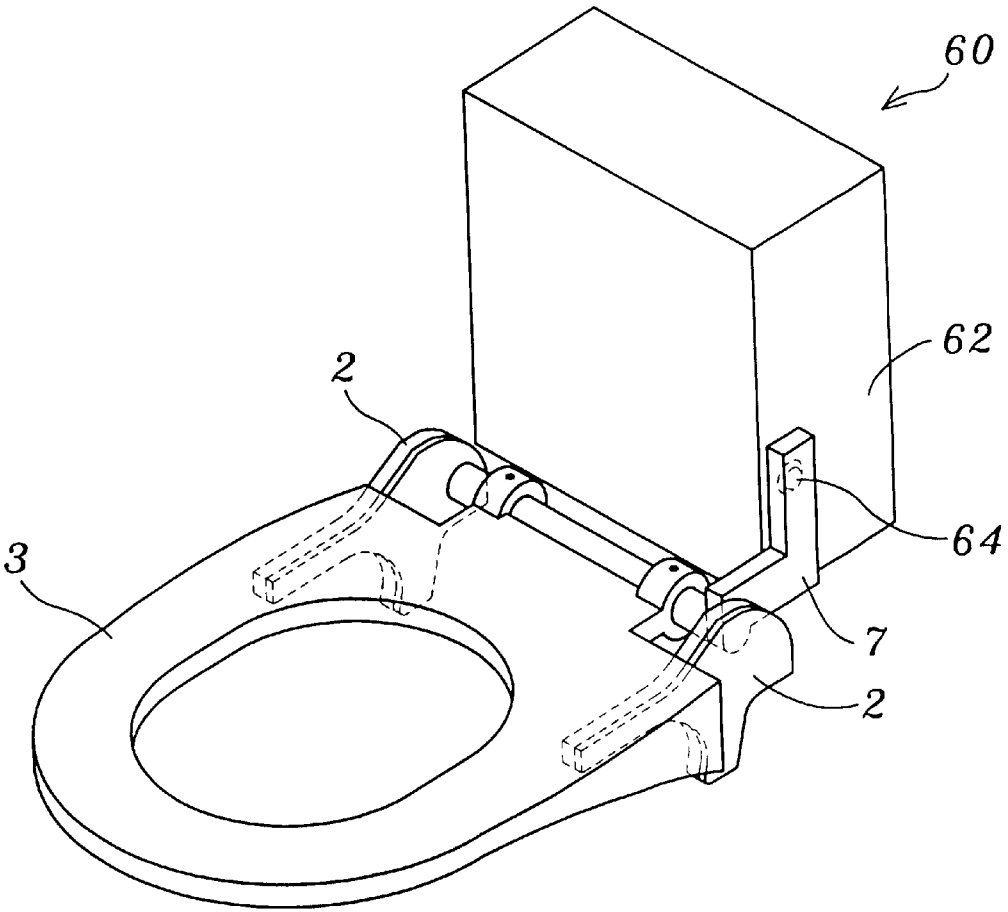

Referring to FIG. 6, there is illustrated a flush initiating macro switch 64 provided on the side of a water tank 60. The depression and release of the macro switch 64 initiates a flush of the toilet. The macro switch 64 may be engaged by a starter 7, which displaces with the toilet seat 3. The starter 7 is installed to extend backward from the toilet seat 3. When the toilet seat 3 is in use, the starter 7 is positioned to remain pressing the macro switch 64 so that the toilet would not be flushed. When the toilet seat is raised by the weight of the balance weight 21 and filling of liquid into the underneath tank 27 within the boxes 2 (as the seat tilts to rise), the starter 7 displaces with the toilet seat 3 and boxes 2 away from the macro switch 64. The starter's disengagement from macro switch 64 permits the starting of a flush.

What is claimed is:

1. An automatically raised toilet seat apparatus comprising:

a toilet seat portion pivotally displaceable between raised and lowered positions, said toilet seat potion having formed therein at least a pair of first holes and at least a pair of second holes, said pairs of first and second holes defining alternative dimensional configurations; and, at least a pair of box portions selectively engaging one of said first and second hole pairs, each said box portion defining a closed space containing a liquid; said box portion including within said closed space a plurality of tank compartments partitioned at least in part by a baffle member, said tank compartments adaptively distributing the liquid for weight biasing said toilet seat portion to one of said lowered and raised positions.

2. The automatically raised toilet seat apparatus as recited in claim 1, further comprising:

a water tank portion disposed adjacent said box portions, said water tank portion including a macro switch for actuating the release of toilet flushing water therefrom; and a starter portion coupled to at least one of said box portions, said starter portion extending from said box portion for maintaining engagement with said macro switch when said toilet seat portion is disposed in one of said raised and lowered positions, and maintaining disengagement from said macro switch when said toilet seat portion is disposed in the other of said raised and lowered positions;

whereby said macro switch is automatically actuated responsive to displacemnent of said starter portion.

3. An automatically raised toilet seat apparatus comprising:

a toilet se,t portion including a transversely extended crankshaft, said toilet seat portion being pivotally displaceable between raised and lowered positions about a pivot axis defined by said crankshaft;

at least a pair of box portions coupled to said crankshaft, each said box portion defining a closed space containing a liquid, said box portion including within said closed space a plurality of tank compartments partitioned at least in part by a baffle member, said tank compartments adaptively distributing the liquid for weight biasing said toilet seat portion to one of said lowered and raised positions;

a water tank portion disposed adjacent said box portions, said water tank portion including a macro switch for actuating the release of toilet flushing water therefrom; and, a starter portion coupled to at least one of said box portions, said starter portion extending from said box portion for maintaining engagement with said macro switch when said toilet seat portion is disposed in one of said raised and lowered positions, and maintaining disengagement from said macro switch when said toilet seat portion is disposed in the other of said raised and lowered positions;

whereby said macro switch is automatically actuated responsive to displacement of said starter portion.

* * * * *